United States Patent [19]

Zucker

[11] 3,984,215

[45] Oct. 5, 1976

[54] ELECTROSTATIC PRECIPITATOR AND METHOD

[75] Inventor: Jerry Zucker, Lake Como, Fla.

[73] Assignee: Hudson Pulp & Paper Corporation, New York, N.Y.

[22] Filed: Jan. 8, 1975

[21] Appl. No.: 539,537

[52] U.S. Cl. ..... 55/2; 55/105; 55/139; 323/20; 323/22 SC; 323/34

[51] Int. Cl.[2] ..... B03C 3/68; G05F 1/56

[58] Field of Search ..... 55/105, 139, 2; 323/4, 323/9, 17, 20, 22 T, 22 SC, 34; 307/44, 45, 69, 72, 73–75

[56] References Cited

UNITED STATES PATENTS

| | | | |
|---|---|---|---|
| 3,443,358 | 5/1969 | Drenning et al. | 55/105 X |
| 3,622,839 | 11/1971 | Abrams et al. | 55/105 |
| 3,873,282 | 3/1975 | Finch | 55/105 |

*Primary Examiner*—Gerald Goldberg
*Attorney, Agent, or Firm*—Harold L. Stults; Donald P. Gillette

[57] ABSTRACT

A method of an apparatus for improving the capacity and efficiency of electrostatic precipitators by increasing the average field intensity. The precipitator is supplied with a substantially constant base level DC voltage that is less than the sparking threshold level of the precipitator, and superimposed thereon is a periodic DC voltage waveform of short duration having peak levels that substantially exceed the sparking threshold level. By controlling the characteristics of the periodic DC voltage waveform the average applied voltage is greater than the sparking voltage but the duration of the instantaneously applied voltage is not sufficient to cause sparking in the precipitator.

12 Claims, 9 Drawing Figures

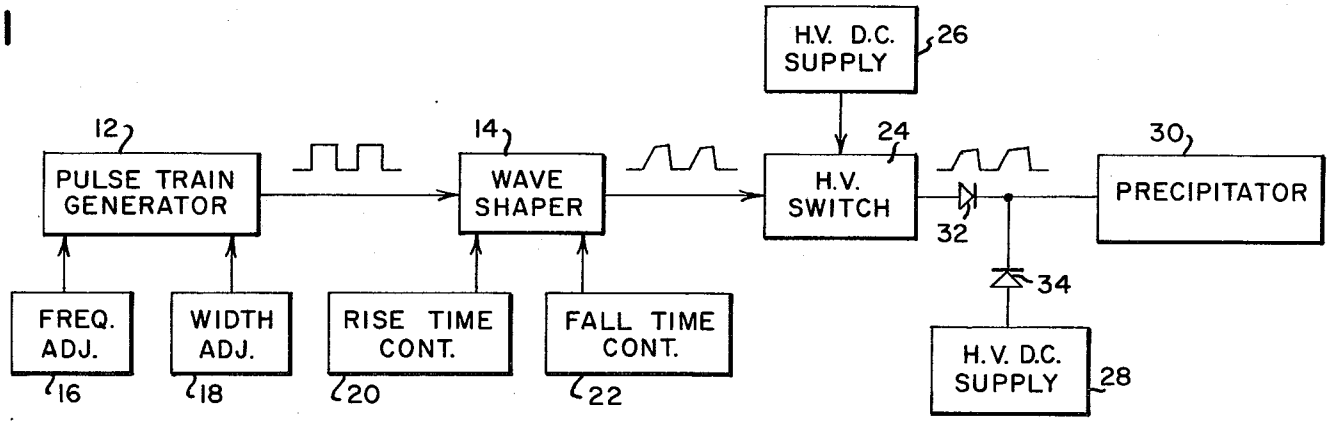
Fig. 1
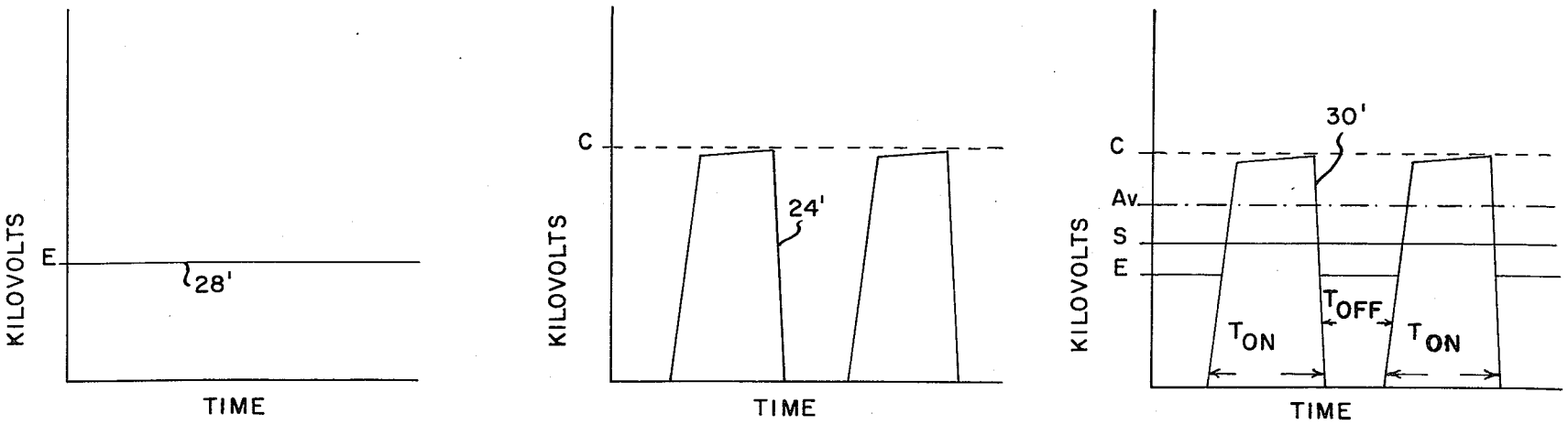
Fig. 2A
Fig. 2B
Fig. 2C

Fig. 3
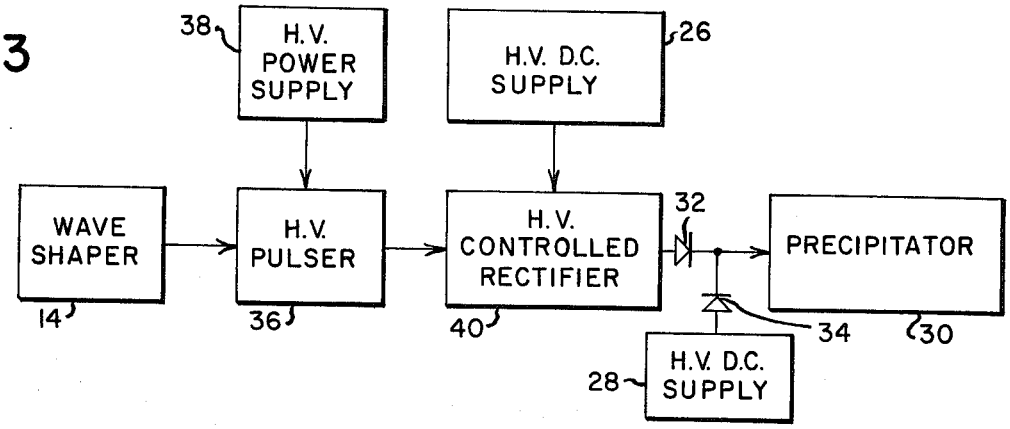
Fig. 4
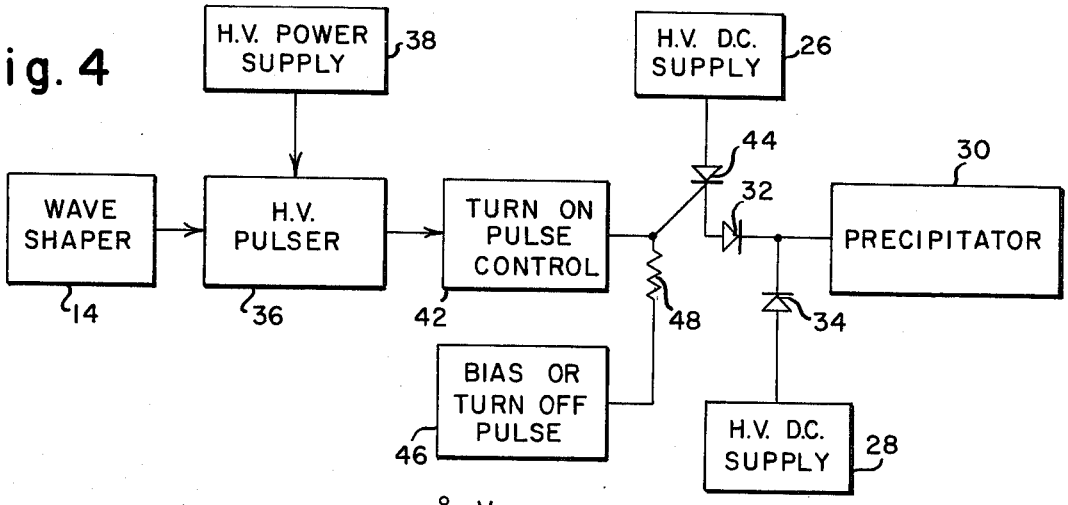
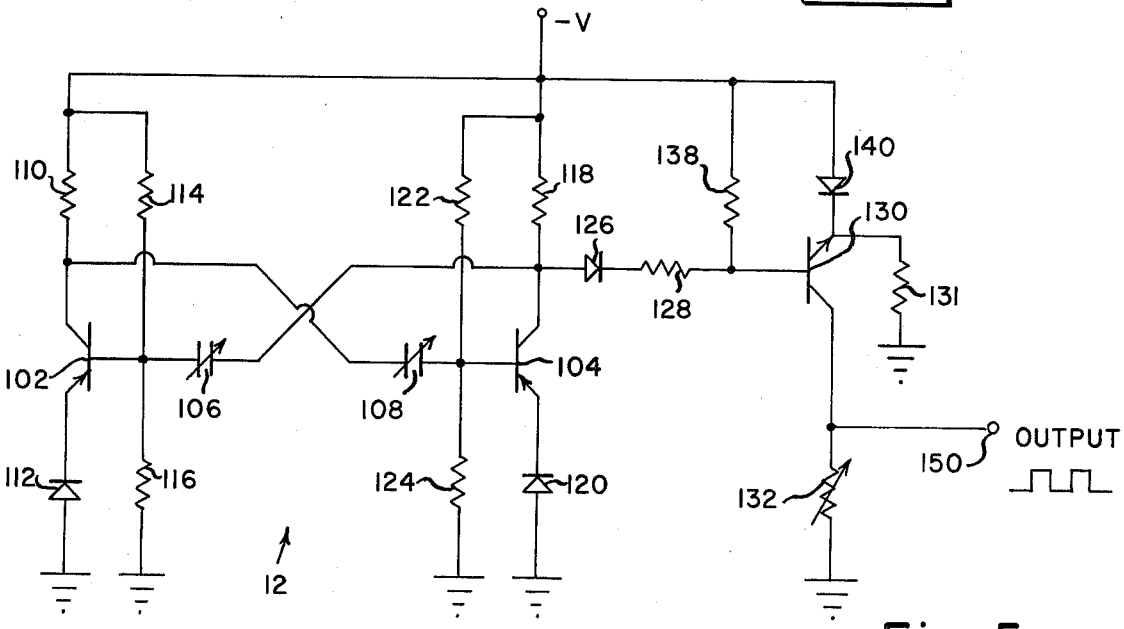
Fig. 5

ELECTROSTATIC PRECIPITATOR AND METHOD

BACKGROUND OF THE INVENTION

The invention herein described, relates to electrostatic precipitators, and more specifically, to improving the electrokinetic characteristics of the precipitator system and increasing its efficiency.

Electrostatic precipitators are used for dust collection in many fields, including: recovery of valuable products in dryers and smelters; collecting powdered products; in pneumatic conveying of spray dried milk, eggs and soap; cleaning air for areas used for the production of pharmaceutical products and photographic film; collecting pollutants for safety and health hazard elimination; and collecting fly-ash from power plant combustion gases.

When particles suspended in a gas are exposed to gas ions in an electrostatic field, they become charged and precipitate out under the action of the field. The functions involved in electrical precipitation include:

1. Gas ionization; and
2. Particle collection, which is achieved by producing an electrostatic field to charge the dust particles, retaining the gas to permit particle migration to a collection surface, preventing re-entrainment of collected particles, and removing the collected particles.

The invention herein described concerns improving the gas ionization and electrostatic field production.

There are two general types of electrical precipitators, single-stage in which ionization and collection are combined, and two-stage in which the ionization is achieved in one zone and the collection in the other zone. The present invention is applicable to both of these types.

In order to obtain gas ionization it is necessary to exceed, at least locally, the electrical breakdown characteristic strength of the gas to produce corona. Sparking and arcing are advanced stages of corona in which complete breakdown of the gas occurs along a given discharge path. Both sparking and arcing undesirable and must be avoided.

Since corona represents a local breakdown, it can occur only in a non-uniform electrical field. For this reason, precipitators use irregular fields, generally with round or square wires suspended between flat plates. The fields are produced by applying to the wires and plates the highest voltage practicable without sparking or arcing. That provides maximum permissible particle charge and electrical precipitating field characteristics, thus increasing the overall efficiency of the precipitator. Corona discharge is accompanied by a relatively small flow of electric current, typically 0.1 to 0.5 milliamperes per square meter of collecting electrode area. Sparking and arcing usually involve a considerable larger flow of current which disrupts the operation, produces low collection efficiency because of the reduction in the applied voltage, causes redispersion of the collected particles, and damages the electrodes.

There are commercially available systems which regulate the current and voltage in precipitators and which tolerate a limited amount of arcing. Since the efficiency of the collection process is proportional to the average applied voltage, such systems attempt to maintain a substantially constant DC applied voltage that is just below the sparking threshold level. Of course, the voltage in such systems cannot continuously exceed the sparking threshold level. This limits the maximum efficiency attainable per unit area of collecting electrodes. Moreover, highly complex feedback apparatus is necessary to provide close regulation of the voltage, and such apparatus adds to the costs of construction and maintenance.

It is an object of this invention to provide methods and apparatus for significantly increasing the capacity and efficiency of electrostatic precipitators. Another object is to provide for operating a precipitator at high efficiency so that the size, weight and cost of the control apparatus are reduced as compared with existing apparatus. It is a further object to provide a precipitator which can be "tuned" to operate at optimum efficiency. An additional object is to obtain the effective use of low cost, small size precipitators at high collection efficiencies. Another object is to eliminate arcing or "breakdown", rather than merely to attempt to control it.

Various other objects and advantages of the invention will become apparent from the ensuing detailed description, and the novel features will be particularly pointed out in the claims.

SUMMARY OF THE INVENTION

In accordance with the present invention, an improved electrostatic precipitator is operated at higher collection capacity and higher efficiency levels by applying thereto a base voltage together with pulses having a voltage greatly in excess of the sparking threshold level but of such short duration that sparking and arcing are not produced. That is effected by providing a substantially constant DC base voltage and then superimposing periodic pulses of short duration having peak voltage levels that substantially exceed the normal sparking threshold level. The characteristics of the pulses are determined for optimum performance of the precipitator and sparking of the precipitator is avoided.

FIG. 1 is a block diagram of the electrical system of an electrostatic precipitator constituting the preferred embodiment of the invention;

FIGS. 2A–2C are waveform diagrams useful in understanding the operation of the system of FIG. 1;

FIG. 3 is a partial block diagram of another embodiment of the present invention;

FIG. 4 is a partial block diagram of another embodiment of the present invention; and FIGS. 5, 6 and 7 are schematic diagrams of different portions of the electrical system of FIG. 1.

Figure 6:
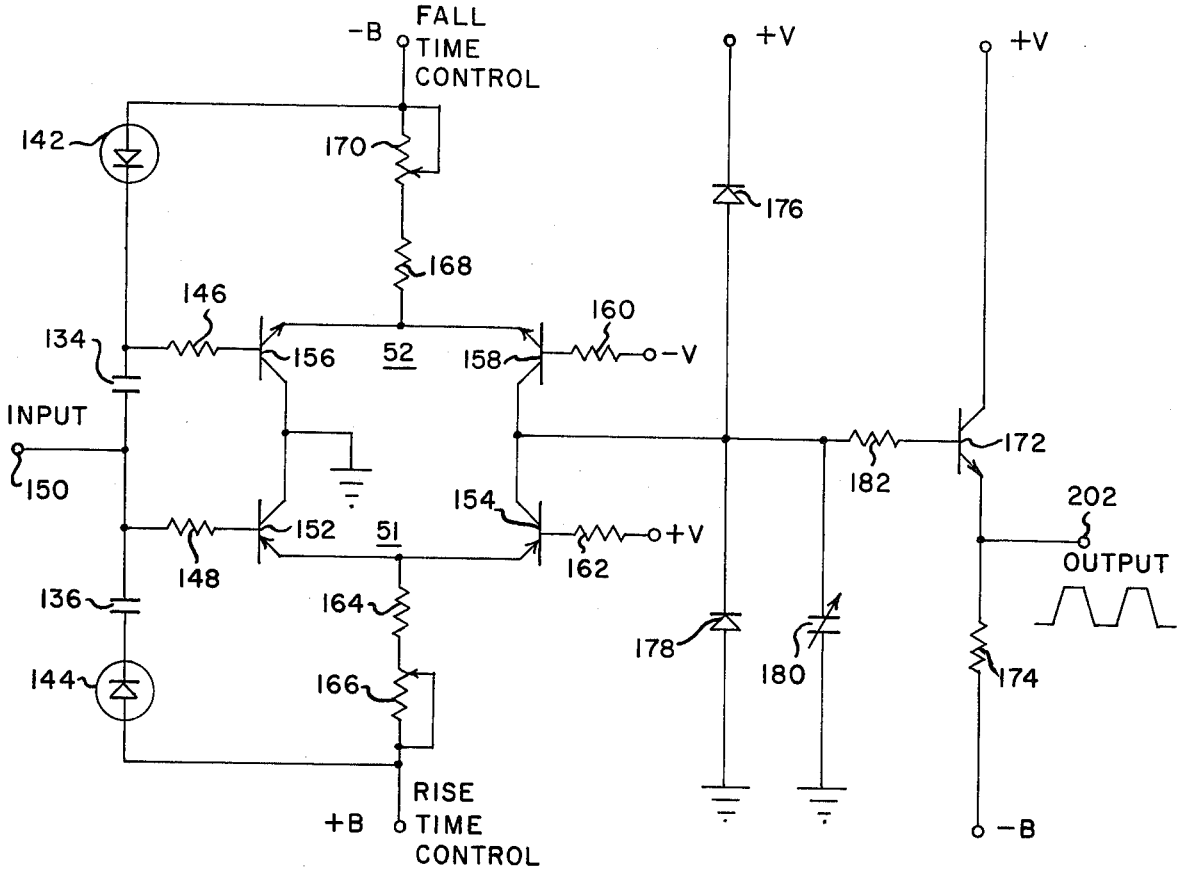

Referring to FIG. 1 of the drawings, an electrostatic precipitator 30 is supplied with DC energy by a pulse train generator 12, a wave shaping circuit 14, a high voltage switch 24 and a high voltage DC supply 28. The pulse train generator 12 is adapted to generate periodic pulse signals in the form of a square wave or other rectangular wave. The pulse train generator comprises a reflex oscillating circuit and an astable multivibrator circuit capable of generating an output pulse signal having a predetermined repetition frequency. The frequency and pulse duration of the pulse signal produced by the pulse train generator 12 are adjusted in accordance with the particular operating characteristics of the precipitator, using a frequency adjustment mechanism 16 and a pulse width adjustment mechanism 18. The manner in which the frequency and pulse duration are controlled by these adjustment mechanisms will be explained in greater detail hereinbelow in connection with FIG. 5.

The output of the pulse train generator 12 is coupled to the wave-shaping circuit 14, in which the pulse signal waveform is selectively modified in accordance with the particular operating characteristics of the precipitator so that the precipitator is operated at optimum efficiency. In particular, the wave-shaping circuit is adapted to selectively modify the shapes of the leading and trailing edges of the pulse signal supplied thereto so as to produce the control signal. To this effect, a rise time control mechanism 20 and a fall time control mechanism 22 are connected to the wave-shaping circuit 14. Mechanisms 20 and 22 are adapted to be selectively and independently adjusted so as to increase or decrease the respective rise and fall times of the pulse signal, as desired to produce the desired waveform of the supplied pulse signal, e.g., triangular, sawtooth or trapezoidal. The preferred wave-shaping circuit will be described below with reference to FIG. 6.

The wave-shaping circuit 14 is coupled to a high voltage switch 24 and supplies a control signal to selectively actuate that switch. When actuated, the high voltage switch transmits a very high DC voltage from a supply 26 to the precipitator 30 for predetermined time periods. The voltage levels which are transmitted through switch 24 to the precipitator are of the order of 60 to 200 kv, and more. Switch 24 may be a solid-state controlled rectifier of a type well known in the art, e.g., a silicon controlled rectifier (SCR) having an anode terminal coupled to the high voltage supply 26, a cathode terminal coupled to precipitator 30 and a gate terminal coupled to the wave-shaping circuit 14, or it may be a series-parallel arrangement of transistors or a grid-controlled tube. The switch is responsive to a control signal applied to the gate or base electrode thereof so as to be turned on, i.e., to its conductive state. When the control signal is terminated, and if a suitable bias potential is supplied to the gate electrode, e.g., a negative bias potential, the switch is turned off, i.e., to its non-conducting state. If the control signal supplied to the switch is of a pulse-type waveform, the switching on and off of the switch follows a similar waveform.

Although a single SCR or transistor device can be used as the high voltage switch 24, provided such device can withstand the voltage levels applied thereto, a commercially available SCR or transistor package can be used, for example, one produced by the semiconductor division of Westinghouse Electric Company. This SCR or transistor package is comprised of an array of SCR or transistor devices that are interconnected in standard configuration so as to accommodate the high voltage magnitudes that are used herein. The array is switched on in response to a control signal supplied to the interconnected gate electrodes thereof, and is turned off when the control signal terminates and a suitable turn-off pulse or bias potential is applied. In another embodiment, the high voltage switch 24 comprises a gate controlled switch (GCS) and a gate turn-off switch (GTO).

The precipitator 30 is additionally supplied with a substantially constant base level DC voltage provided by the high voltage DC supply 28. The voltage provided by supply 28 is less than the sparking threshold level of the precipitator 30. Although each of the high voltage switch 24 and the high voltage DC supply 28 may be connected directly to the precipitator 30, additional rectifier devices, such as diodes 32 and 34 (FIG. 1), are provided as a safety precaution. The DC voltages provided by the high voltage DC supplies 26 and 28 are produced by conventional transformer and full-wave rectifier circuit combinations. Such transformers comprise conventional high power step-up transformers wherein the full-wave rectifier circuits with rectifier bridges are connected to the transformer secondary windings.

The operation of the precipitator energizing apparatus will now be described, in connection with the waveforms represented in FIGS. 2A–2C. The operating efficiency of a precipitator, for example, its collection per unit of supply voltage, increases as the level of operating voltage increases. Theoretically, optimum efficiency is achieved at the highest supply voltage levels, and the actual peak magnitude of the supplied voltage is limited by the sparking threshold level of the precipitator. Although the particular sparking threshold level of a precipitator is dependent upon its physical dimensions, electrical characteristics, and the medium with which it is used, all precipitators exhibit a determinable sparking threshold level. When the supplied voltage exceeds this sparking threshold level, a sparking condition occurs, which may be followed by an arcing condition, which may make the precipitator no longer operable. Thus, the prior art has found it necessary to insure that the operating potential supplied to the precipitator is accurately controlled so that the sparking threshold level is not exceeded. In practice, the voltage and current conditions of the precipitator are constantly monitored and elaborate feedback apparatus is provided to control the supplied operating voltage. Even though some occurrences of sparking are tolerated, the average voltage that can be supplied to the precipitator by such prior art systems is significantly less than that which produces optium efficiency per unit of electrode surface ares, such average voltage being limited to a maximum equal to or less than the sparking threshold voltage for the precipitator.

In accordance with the present invention, this problem is overcome by the apparatus illustrated in FIG. 1, as will now be explained. Let it be assumed that, for the given precipitator 30, the sparking threshold level is about 50–65 kv. That is, if the operating voltage supplied to the precipitator exceeds this range, sparking occurs. Therefore, the base level DC voltage supplied to the precipitator by the high voltage DC supply 28 is maintained below this sparking threshold level and, preferably, at a magnitude of approximately 90% of the sparking threshold level. Thus, the high voltage DC supply 28 supplies a base level DC voltage of approximately 40–55 kv. This is represented in FIG. 2A as the base level DC voltage E. With that base voltage being maintained, the high voltage switch 24 is closed to supply a periodic DC voltage waveform that is superimposed onto the base level DC voltage. This periodic DC voltage waveform has peak levels that substantially exceed the sparking threshold level. For the precipitator under consideration, the peak levels of the periodic DC voltage supplied by the high voltage switch 24 are of the order of 100–200 kv. Even though these maximum peak levels of the periodic DC voltage far exceed the sparking threshold level, it has been found that a finite interval of time is required before the corona discharge between the precipitator electrodes breaks down to produce sparking. Accordingly, the duration of the applied periodic DC voltage is less than this finite time interval, and sparking cannot occur, notwithstanding the excessively large voltage applied. It also has been found that, after the excessive DC voltage is removed from the precipitator, another finite interval of time is required for the precipitator to return to its quiescent condition at the base voltage of supply 28. These time intervals determine the limits of frequency and duration of the periodic DC voltage which can be applied by the high voltage switch 24. The output of the high voltage switch is depicted in FIG. 2B wherein the peak levels of the periodic DC voltage waveform 24' are indicated at C.

The pulse train generator 12 produces a periodic pulse signal having a repetition frequency and pulse duration determined by the intrinsic limits attending the operating parameters of the precipitator 30. Thus, as various precipitators having differing characteristics are used, the frequency and duration of the pulse signal produced by the generator 12 must be adjusted accordingly. The frequency adjustment mechanism 16 and the pulse width adjustment mechanism 18 enable the selective modification of the repetition frequency and pulse duration of the generated pulse train.

The particular shape of the pulse signal thus produced is further modified by the wave shaping circuit 14 so as to match the operating characteristics of the precipitator. Hence, the rise time of the pulse signal may be selectively increased or decreased to correspondingly vary the slope of the leading edge of the pulse signal, and the fall time of the pulse signal can be similarly, but independently, modified. Such modification is effected by the rise time control mechanism 20 and the fall time control mechanism 22, respectively. The thus modified pulse signal is then supplied to the high voltage switch 24 to actuate same. It should be appreciated that the waveform of the control signal thus produced by the wave shaping circuit 14 is similar to the waveform 24' of FIG. 2B.

When the high voltage switch 24 is actuated by the control pulse signal supplied thereto, the high DC voltage of the supply 26 is coupled through the switch 24 to the precipirator 30. Thus it is seen that the periodic DC voltage supplied by the high voltage switch exhibits a substantially identical waveform to that exhibited by the control pulse signal which actuates the switch. When the switch 24 is closed during such control pulse duration, the excessive high DC voltage is supplied to the precipitator; and when switch 24 is opened, the supply of such high DC voltage is interrupted.

The periodic DC voltage supplied by the high voltage switch 24 is electrically combined with the base level DC voltage supplied by the high voltage DC supply 28. The resultant superimposition of the base level DC voltage and the periodic DC voltage waveform is illustrated as the waveform 30' in FIG. 2C. The resultant operating voltage supplied to the precipitator 30 is thus seen to be the base DC level E with the periodic increase to the peak levels C at the frequency of the control pulse signal generated by the pulse train generator 12. The slopes of the rise and fall times of the waveform 30' are determined by the operation of the wave shaping circuit 14. Therefore, it should be fully understood that the average operating voltage $A_v$ applied to the electrostatic precipitator 30 is well in excess of the sparking threshold level S so as to insure optimum operating efficiency, but a sparking condition is precluded because the maximum duration $T_{on}$ of the periodic DC voltage is not great enough to permit the precipitator air gap to break down.

It has been found experimentally that, as the frequency of the control signal (and thus the frequency of the periodic DC voltage supplied to the precipitator by the high voltage switch 24) increases, the duration of each pulse must be reduced. Conversely, as the frequency of the control signal decreases, the pulse duration thereof may be increased, but within the time interval limits noted hereinabove for the particular precipitator which is used. In most applications, the pulse duration of the periodic DC voltage is preferably as wide as possible without causing arcing. The frequency of this periodic DC voltage can then be established within the constraints demanded by the requisite quenching time between pulses, which is often a function of the precipitator electrodes and gas velocity. It has further been found that the operating efficiency of the precipitator can be optimized by first minimizing the fall time of the control signal (and thus the periodic DC voltage) and by adjusting the rise time of the control signal. When maximum operating efficiency is thus obtained, the fall time of the control signal is then adjusted to further improve the efficiency. Thus, by selectively determining the wave shape characteristics of the periodic DC voltage, the precipitator can be effectively tuned to optimum efficiency.

By the aforedescribed embodiment of the present invention, sparking of the precipitator is avoided and the complex feedback apparatus, heretofore required in prior art control systems, is unnecessary. However, if desired, the present invention can be used with such prior art systems, and the feedback systems therein will not deleteriously affect the optimized operation attained by the illustrated apparatus.

An alternative embodiment of a portion of the energizing apparatus of the present invention is illustrated in FIG. 3 wherein those components that are identical to the previously described components of FIG. 1 are identified by the same reference numerals. Thus, as is illustrated in FIG. 3, the precipitator 30 is supplied with a base level DC voltage applied by the high voltage DC supply 28. Additionally, the high voltage DC potential provided by the high voltage DC supply 26 is adapted to be periodically switched to the precipitator 30 under the control of the control signal having a predeterminedly shaped waveform, obtained from the wave shaping circuit 14. In particular, it is seen that the high voltage switch 24 of FIG. 1 is now replaced by the combination of a high voltage pulsing circuit 36 and a high voltage controlled rectifier 40. Although the high voltage controlled rectifier can be similar to the SCR devices and other controlled rectifiers, it will here be assumed that the control signal necessary to actuate the rectifier 40 must be of sufficiently high magnitude, and that the control signal produced by the pulse train generator 12 and wave shaping circuit 14 has of a peak level that is not sufficient to so actuate the rectifier. Accordingly, it is necessary to convert the relatively low-level control signal to a control signal of magnitude which is compatible with the operating prerequisites of the high voltage control rectifier 40.

The purpose of the high voltage pulsing circuit is to convert the control signal supplied by the wave shaping circuit 14 to the necessary levels for actuating the rectifier 40. A particular circuit embodiment of the high voltage pulsing circuit 36 will be described hereinbelow with reference to FIG. 7. For the present discussion, it may merely be pointed out that the high voltage pulsing circuit 36 is adapted to respond to a relatively low-level control signal so as to switch a higher voltage supplied thereto by a high voltage power supply 38 to an output terminal. The resultant output waveform produced by the high voltage pulsing circuit is substantially identical to the waveform of the control signal applied thereto except of a higher rise time and decreased fall time. Accordingly, when the pulsing circuit is turned on by the control signal, a transmission path extends therethrough from the power supply 38 to the high voltage controlled rectifier 40. Conversely, when the control signal duration terminates, the pulsing circuit 36 is turned off to thereby interrupt the supply of high voltage from the power supply to the rectifier. The high voltage pulsing circuit thus serves as a useful bridge, or interface, for enabling relatively low-level control signals to operate high voltage switching devices.

The operation of the alternative embodiment illustrated in FIG. 3 is substantially similar to the operation of the apparatus in FIG. 1. Accordingly, in the interest of brevity, further description thereof will not be provided. Suffice it to say, however, that the pulsing circuit 36 operates to switch the high voltage controlled rectifier 40 in a manner such that the periodic DC voltage represented as waveform 24' is supplied by the rectifier and is superimposed onto the base level DC voltage provided by the DC supply 28. Consequently, the precipitator 30 is supplied with an operating voltage waveform similar to that represented by the waveform 30' in FIG. 2C.

A still further embodiment of a portion of the energizing apparatus of the present invention is depicted in FIG. 4. This embodiment is substantially similar to the just-described embodiment of FIG. 3; but the high voltage controlled rectifier 40 is depicted as a high voltage silicon controlled rectifier 44 supplied with a gate control signal by a turn-on pulse control circuit 42. As thus shown, the anode of the SCR 44 is connected to the high voltage DC supply 26 and the cathode of the SCR is coupled to the precipitator 30. The gate electrode of the SCR is supplied with a bias or pulsed potential by a bias or pulse source 46 connected through a resistor 48. The gate electrode is further connected to a pulse control circuit 42 whereby a control pulse supplied thereby to the gate electrode is effective to turn the SCR on.

It may be appreciated that the high voltage pulsing circuit 36 might produce a high voltage control pulse sufficient to actuate the SCR, but might not faithfully reproduce the waveform of the control pulse supplied thereto by the wave shaping circuit 14. Therefore, the pulse control circuit 42 is adapted to modify the high voltage control pulse in a manner similar to that of the wave shaping circuit, described above. Accordingly, this pulse control circuit is provided with suitable adjusting devices, such as potentiometers, variable capacitors, and the like, whereby the rise and fall times of the high voltage pulse produced by the high voltage pulsing circuit 36 are respectively modified. In this manner, the high voltage gating pulse necessary to turn on the SCR 44 is modified to match the operating characteristics of the electrostatic precipitator.

It, of course, is recognized that the SCR device 44 can be replaced by a conventional thyrister device or other solid-state switching mechanism, or by a conventional high voltage rectifier tube, such as a thyratron, ignitron, excitron, and the like. When such alternative switching devices are used, the high voltage pulsing circuit 36 and the pulse control circuit 42 are provided to supply high voltage control pulses exhibiting appropriately modified waveform characteristics so that the particular switching device can be actuated to supply the necessary periodic DC voltage to the precipitator, whereby optimum efficiency is attained.

The operation of the embodiment illustrated in FIG. 4 is substantially similar to the operation of the FIGS. 1 and 3 embodiments, described above. Briefly, the control pulse signal having suitable frequency, duration and wave shape, as ultimately supplied by the wave shaping circuit 14, is applied to the voltage pulsing circuit 36 so as to energize the pulsing circuit to produce a high voltage gating pulse of substantially the same frequency and duration as the control pulse. The shape of this high voltage control pulse is then appropriately modified by the pulse control circuit 42 whereby the rise and fall time characteristics are adjusted in correspondence with the operating parameters of the particular precipitator to be energized. The resultant modified high voltage gating pulse is then coupled to the SCR device 44.

Prior to receiving the high voltage gating pulse, the bias circuit 46 supplies a suitable bias potential, such as a negative bias voltage, through the resistor 48 to the gate electrode of the SCR device. This bias potential or bias pulse is sufficient to maintain the SCR device in its non-conductive state. Consequently, until the SCR device is actuated, only the base level DC voltage supplied by the high voltage supply 28 is applied to the precipitator 30. Now, in response to the high voltage gating pulse supplied thereto, the bias potential at the gate electrode is overcome or terminated and the SCR device 44 is actuated to its conducting state. Consequently, a conducting path is established between the high voltage supply 26, through the SCR device 44 and to the precipitator 30. The total energizing voltage now supplied to the precipitator increases to exceed the sparking threshold level thereof. However, as the duration of the high voltage gating pulse is less than the time interval necessary for the precipitator air gap to break down the termination of the high voltage gating pulse enables the bias potential supplied to the SCR gate to return to its previous turn-off level, causing the SCR device to be deactuated and to interrupt the conducting path therethrough. Hence, the high DC voltage supplied to the precipitator by the high voltage supply 26 decreases and the total energizing voltage now supplied to the precipitator is restored to the base level. The continued operation of the illustrated apparatus in response to the periodic control signal produced by the wave shaping circuit 14 results in the superimposition of a periodic high DC voltage on the base level DC voltage. Accordingly, although the average energizing voltage supplied to the precipitator substantially exceeds the sparking threshold level thereof, a sparking condition is avoided.

It should be readily apparent that the foregoing description of the operation of the illustrated embodiment is equally applicable to those alternative embodiments wherein the SCR device 44 is replaced by other high voltage switching devices.

A preferred embodiment of the pulse train generating circuit 12 will now be described with reference to FIG. 5. It is recalled that the pulse train generating circuit may comprise a reflex oscillator, such as a square wave generator, or other oscillating circuit, such as an astable multivibrator, or the like. In the preferred embodiment thereof, the pulse train generating circuit is comprised of a multivibrator circuit including cross-coupled transistors 102 and 104. In particular, a first section of the multivibrator circuit is comprised of the transistor 102 having its base electrode connected via a variable capacitor 106 to the collector electrode of the transistor 104. Similarly, the base electrode of the transistor 104 is connected via a variable capacitor 108 to the collector electrode of the transistor 102. In addition, respective collector load resistors 110 and 118 serve to couple the respective collector electrodes of the transistors to a suitable source of operating potential −V. The respective emitter electrodes of the transistors are connected to a reference potential, such as ground, by diodes 112 and 120, respectively. Finally, the respective base electrodes of the transistors are suitably biased by, for example, voltage divider networks formed of series resistors 114 and 116, and series resistors 122 and 124, respectively.

As is appreciated, the illustrated multivibrator circuit oscillates at a frequency determined by the capacitance impedence of the respective cross-coupling capacitors 106 and 108, respectively. The pulse duration of the periodic signal produced by the multivibrator circuit is determined in accordance with an output stage coupled to the collector electrode of the transistor 104.

As shown, the output of the transistor 104 is connected to a transistor 130 via a diode 126 and resistor 128, connected in series between the collector electrode of the transistor 104 and the base electrode of the transistor 130. The diode 126 performs a rectifying function so as to restrict the multivibrator output to a unidirectional pulse having a polarity sufficient to bias the transistor 130 to its conducting state. A bias resistor 138 is connected between the base electrode of the transistor 130 and the source of operating potential −V.

The transistor 130, which is here illustrated as an NPN transistor, includes an emitter electrode connected through a diode 140 to the source of energizing potential and a collector electrode connected to an output terminal 150. A variable resistor 132 is connected from the collector electrode of the transistor 130 to ground. The particular resistance value of this resistor is determinative of the duration of the pulse signal produced at the output terminal 150.

As shown in FIG. 6, the resistor 132 is part of an RC network that further includes a capacitor 134 connected in series with a diode 142 between the output terminal 150 and the source of energizing potential −V. Also included in the RC network are a capacitor 136 connected in series with a diode 144 between the output terminal 150 and a source of operating potential +V. Therefore, by varying the resistance value of the variable resistor 132, the duration of the pulses produced at the output terminal 150 will be correspondingly varied, but the frequency of such pulse signals will be dependent upon the capacitance values of the variable capacitors 106 and 108. Therefore, by adjusting the illustrated variable capacitors and the variable resistor, an operator can produce a periodic pulse signal having frequency and duration which are matched to operating parameters of the electrostatic precipitator so that the precipitator can be operated at optimum efficiency.

A preferred wave shaping circuit which can be used as the wave shaping circuit 14 will now be described with reference to FIG. 6. The illustrated wave shaping circuit is comprised of a dual differential amplifier having an input coupled to the output terminal 150 of the aforedescribed pulse train generating circuit 12 and an output connected through an emitter-follower amplifier to an output terminal 202. The dual differential amplifier is comprised of first and second cascade-connected stages 51 and 52. Each stage comprises a differential amplifier formed of a pair of transistors connected in conventional differential amplifier configuration. Adjustable circuit elements such as potentiometers, are connected to the respective cascade-connected stages.

In particular, a first differential amplifier styled circuit 51 is formed of transistors 152 and 154 having common-connected emitter electrodes. Transistors 152 and 154 act as a constant current sink the base electrode of the transister 152 is connected via a coupling circuit formed of a capacitor 136 and a series-connected resistor 148 to the terminal 150. The base electrodes of the transister 154 is connected to a reference potential, such as +V, by a coupling resistor 162. As illustrated, the common-connected emitter electrodes of the transistor 152 and 154 are connected via resistor 164 to a variable resistor 166. The variable resistor may comprise, for example, a potentiometer having its wiper arm electrically connected to one end thereof, the potentiometer being further connected to a source of operating potential +B.

The cascade-connected stage 52 is formed of differentially connected transistors 156 and 158 in a manner similar to the stage 51. Transistors 156 and 158 act as a constant current source feeding transistors 152 and 154. In particular, the transistor 156 includes a base electrode connected to the terminal 150 via a coupling circuit formed of a capacitor 134 and a resistor 146. The base electrode of the transistor 158 is connected to a reference potential −V via a coupling resistor 160. The common-connected emitter electrodes of the transistors are connected through a resistor 168 to a variable resistor 170. The variable resistor 170 is similar to the aforedescribed variable resistor 166 and may comprise, for example, a potentiometer having its wiper arm connected to one end of the potentiometer. The potentiometer is further connected to a source of operating potential −B.

As further illustrated, the collector electrodes of the transistors 152 and 156 are connected in series, the junction defined thereby being supplied with a reference potential, such as ground. Similarly, the collector electrodes of the transistors 154 and 158 are connected in series, the junction defined thereby being exploited as an output terminal. Although the stage 51 is shown as being comprised of PNP transistors, and the stage 52 is shown as being comprised of NPN transistors, it should be appreciated that transistors of other type polarities can be interchanged with the illustrated components.

The output of the dual differential styled circuit is coupled to the base electrode of an emitter-follower transistor 172 by diodes 176 and 178, variable capacitor 180 and a current limiting resistor 182. The diodes 176 and 178 are connected in series between a source of operating potential +V and ground. The junction defined by the series-connected diodes is coupled to the output terminal of the dual differential current pair. It is appreciated that these diodes limit the range of excursion of the pulse signal derived at the output terminal of the dual differential amplifier.

The variable capacitor 180 is connected between the output terminal of the dual differential styled current pair and ground and serves to establish the operable range of the rise and fall times of the pulse signal produced by the dual differential amplifier. Accordingly, the particular capacitance value of the variable capacitor 180 serves as a coarse adjustment for the rise and fall time range for the wave shape of the pulse signal.

The output of the dual differential current pair is further connected through the current limiting resistor to the emitter-follower transistor 172 and then to the output terminal 202. In its emitter-follower configuration, the collector electrode of the transistor 172 is connected to the operating potential +V and the emitter electrode thereof is connected through an emitter load resistor 174 to a source of operating potential −B.

The variable resistor 166 is designated as the rise time control device whereby a modification in the resistance value thereof causes a corresponding change in the rise time of the pulse signal supplied to the wave shaping circuit. The variable resistor 170 is designated as the fall time control device because a modification in the resistance value thereof causes a corresponding change in the fall time of the pulse signal. Rise and fall time adjustments in the pulse signal are effected independently of each other. It may be appreciated that the variable resistors 166 and 170 operate as fine adjustments in the rise and fall time to thereby effect corresponding changes in the wave shape of the pulse signal, within the range established by the capacitance value of the variable capacitor 180. In practice, it is preferable to initially adjust the fall time variable resistor 170 so that the fall time of the pulse signal is of maximum slope and to then adjust the rise time variable resistor 166 until maximum efficiency in the precipitator operation is attained. Then, further operation of the fall time variable resistor 170 will improve the operating efficiency of the precipitator to its optimum level.

Figure 7:
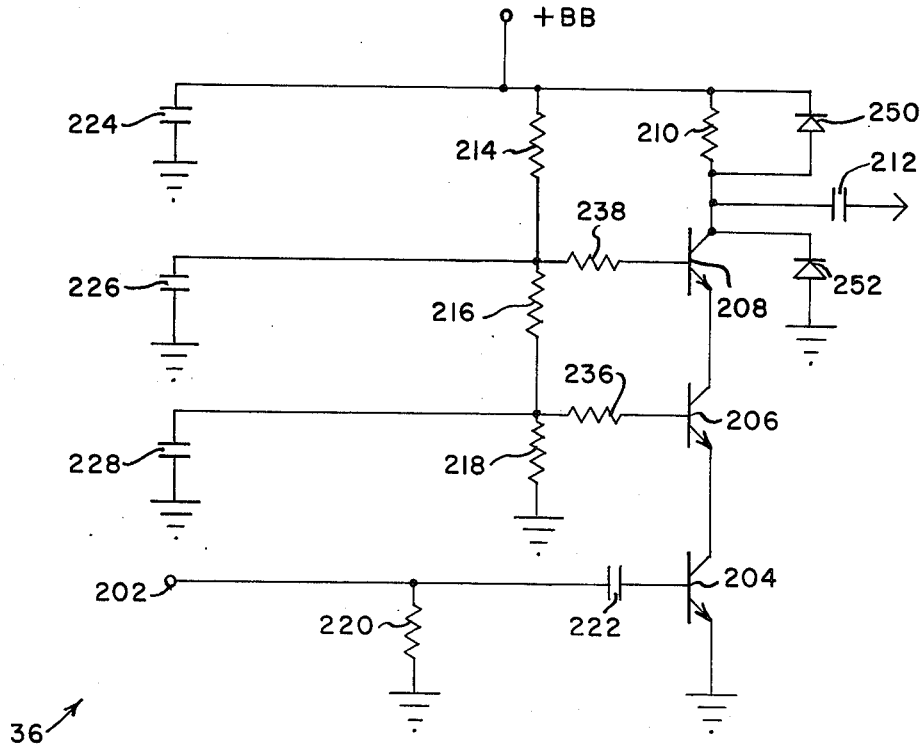

One preferred embodiment of the high voltage pulsing circuit 36 will now be described with reference to FIG. 7. The high voltage pulsing circuit is comprised of a plurality of transistors, only three of which are here illustrated as transistors 204, 206, and 208. The transistors are interconnected in circuit such that a relatively low level pulse supplied thereto will result in a high voltage pulse having the same frequency, and comparable duration as the control pulse. Thus, the high voltage pulsing circuit illustrated in FIG. 7 can be used to receive the relatively low level pulses produced at the output terminal 202 of the wave shaping circuit illustrated in FIG. 6.

The transistors 204, 206 and 208 are each of relatively low voltage rating and are connected in voltage divider configuration wherein their respective collector-emitter circuits are connected in series. In particular, the collector-emitter circuits of the transistors 204, 206 and 208 are connected in series between a source of high voltage energizing potential +BB via resistor 210 and a reference potential, such as ground. The transistors are adapted to distribute thereacross the high voltage supplied by the energizing source such that the voltage supplied to each transistor does not exceed its relatively low level voltage rating. However, as is appreciated, the high voltage output pulse derived from the collector electrode of the first transistor 208 admits of a peak level that is equal to the sum of the lower level collector-emitter voltages of each transistor. Consequently, a high voltage control pulse, suitable to energize the particular high voltage controlled rectifier 40 or high voltage SCR device 44 is produced by using lower voltage rated elements which are actuated by a low-level control pulse.

As shown, the terminal 202 to which the low-level control pulse is applied is connected via a coupling capacitor 222 to the base electrode of the transistor 204. A bias resistor 220 couples the terminal 202 to ground. A voltage divider network formed of series-connected resistors 214, 216 and 218, coupled between the high voltage energizing potential source +BB and ground, derives a plurality of biasing potentials which are supplied to the respective transistors 206 and 208. In particular, the junction defined by the divider resistors 214 and 216 is coupled to the base electrode of the transistor 208 via a current limiting resistor 238; and the junction defined by the divider resistors 216 and 218 is coupled to the base electrode of the transistor 206 via a current limiting resistor 236. The respective divider resistors are shunted to ground by capacitors 224, 226 and 228, respectively. Diodes 250 and 252 are used only to protect the transistors from spurious high voltage spikes.

It should be fully appreciated that any desired number of transistors can be used in the high voltage pulsing circuit 36, and a corresponding number of divider resistors will also be employed. The particular number of transistors (and divider resistors) is a function of the voltage rating thereof, the magnitude of the source of energizing potential +BB and the desired magnitude of the resultant output pulse which is coupled to the pulsing circuit output terminal by the coupling capacitor 212.

In operation, it is seen that if the control pulse applied to the terminal 202 exhibits a rise time of finite slope, then as the voltage level of this pulse gradually increases the respective transistors 204, 206 and 208 will be sequentially actuated. When the control pulse reaches its maximum level, all of the transistors will be conducting. The converse operation obtains in accordance with the fall time of the control pulse. Accordingly, the pulsing circuit is capable of operating as a sequential high voltage pulser.

While the invention has been particularly shown and described with reference to a plurality of embodiments thereof, and some particular circuit configurations have been specifically disclosed, it will be obvious to those of ordinary skill in the art that the present invention admits of various modifications and changes in form and details. For example, if the high voltage switch is comprised of solid state switching elements, such as SCR devices, it is appreciated that an array of such devices can be used. Suitable SCR arrays are commercially available, as are other solid state switching arrays. Also, although diodes 32 and 34 are optional, such diodes can comprise individual high voltage rectifying elements or, alternatively, may be comprised of a plurality of solid state diode arrays. It is appreciated that the use of diode arrays permits the use of a plurality of individual rectifier elements, each of which admits of a relatively low voltage and current rating, but the combination thereof being sufficient to accommodate the high voltages supplied to the precipitator. Additionally, in the circuit diagrams schematically illustrated in FIGS. 5–7, the various polarities of the transistors can be readily interchanged, as desired, and substitutions of various types and polarities of transistors will not affect the underlying principles upon which the present invention is based. Therefore, the foregoing and various other changes and modifications in form and details may be made without departing from the spirit and scope of the invention; and the appended claims are to be interpreted as including all such changes and modifications.

What is claimed is:

1. Apparatus for operating an electrostatic precipitator comprising: voltage supply means connected to said precipitator for supplying thereto a substantially constant DC voltage having a magnitude greater than the corona discharge level but less than the sparking threshold level of said precipitator; and periodic impulse voltage supply means connected to said precipitator for supplying thereto successive impulses having peak voltage levels, each of which substantially exceeds said sparking threshold level, each of said impulses having a voltage that exceeds said sparking threshold level for a length of time less than sufficient to cause a sparking condition in said precipitator.

2. The apparatus of claim 1 wherein said periodic impulse voltage supply means comprises: control signal generating means for generating a periodic control signal having a selectively adjustable waveform; a source of high DC voltage having a magnitude substantially equal to said peak level of said periodic impulse voltage; and switch means interposed between said source of high DC voltage and said precipitator and responsive to said control signal for selectively transmitting said high DC voltage to said precipitator, whereby the waveform of each of said pulses of high DC voltage is in direct correspondence with said control signal waveform.

3. The apparatus of claim 2 wherein said control signal generating means comprises pulse generating means for generating a periodic pulse signal having a frequency characteristic, a duration characteristic, a rise time characteristic, and a fall time characteristic; wave shaping means coupled to said pulse generating means for selectively modifying the waveform of said periodic pulse signal; and adjusting means for selectively adjusting at least one of said characteristics of said periodic pulse signal.

4. The apparatus of claim 3 wherein said switch means comprises silicon controlled rectifier means having anode means coupled to said source of high voltage DC potential; cathode means coupled to said precipitator; and gate means coupled to said wave shaping means.

5. The apparatus of claim 4 further comprising bias means coupled to said gate means for supplying a predetermined bias voltage thereto to render said silicon controlled rectifier non-conductive, said bias means comprising transistor array means connected to said pulse generating means to be rendered non-conductive upon the termination of said periodic pulse signal.

6. The apparatus of claim 3 wherein said switch means is selectively energized in response to a high voltage control pulse applied thereto said apparatus also comprising conversion means coupled to said wave shaping means for converting said control signal to a high voltage control pulse having a magnitude sufficient to energize said high voltage rectifier means.

7. The apparatus of claim 6 further comprising high voltage control pulse modifying means coupled to said conversion means for selectively modifying the waveform of said high voltage control pulse to thereby match the operating parameters of said precipitator so as to operate said precipitator at optimum efficiency.

8. A method of energizing an electrostatic precipitator, comprising the steps of: applying to said precipitator a substantially constant DC voltage having a value which is less than the sparking threshold level of said precipitator; and applying to said precipitator a series of voltage impulses, each of said impulses having a peak level that substantially exceeds said sparking threshold level for a length of time that is not of sufficient duration to produce a sparking condition whereby the average DC voltage level applied to said precipitator is greater than said sparking threshold level.

9. The method of claim 8, wherein said step of applying a series of voltage impulses comprises the steps of: generating a control impulse signal of predetermined waveform and repetition rate; and selectively switching to said precipitator in direct correspondence with said predetermined waveform a supply of high DC voltage having a magnitude that substantially exceeds said sparking threshold level.

10. The method of claim 9 wherein said step of generating a control impulse signal of predetermined waveform and repetition rate comprises the steps of: generating a periodic pulse signal having a rise time characteristic, a duration characteristic, a fall time characteristic, and a repetition rate characteristic wherein at least one of said characteristics is selectively adjustable, whereby the high DC voltage supplied to said precipitator exhibits the desired corresponding waveform.

11. The method of claim 8 in which the value of said substantially constant DC voltage is approximately 90% of said sparking threshold level.

12. The method of claim 8 in which said peak level of said impulses is at least substantially twice as great as said sparking threshold level.

* * * * *

UNITED STATES PATENT OFFICE

CERTIFICATE OF CORRECTION

Patent No. 3,984,215 Dated October 5, 1976

Inventor(s) Jerry Zucker

It is certified that error appears in the above-identified patent and that said Letters Patent are hereby corrected as shown below:

In the heading, the name of the assignee is changed from "Hudson Pulp & Paper Corporation" to ---Hudson Pulp & Paper Corp.---

Signed and Sealed this

Seventh Day of June 1977

[SEAL]

*Attest:*

RUTH C. MASON
*Attesting Officer*

C. MARSHALL DANN
*Commissioner of Patents and Trademarks*